US008731809B2

(12) United States Patent
Koshizen

(10) Patent No.: US 8,731,809 B2
(45) Date of Patent: May 20, 2014

(54) TRAFFIC CONGESTION PREDICTION METHOD

(75) Inventor: Takamasa Koshizen, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/991,609

(22) PCT Filed: Dec. 9, 2011

(86) PCT No.: PCT/JP2011/006880
§ 371 (c)(1),
(2), (4) Date: Jun. 4, 2013

(87) PCT Pub. No.: WO2012/081209
PCT Pub. Date: Jun. 21, 2012

(65) Prior Publication Data

US 2013/0261944 A1 Oct. 3, 2013

(30) Foreign Application Priority Data

Dec. 15, 2010 (JP) ..... 2010-278754

(51) Int. Cl.
*G08G 1/00* (2006.01)
*G08G 1/01* (2006.01)

(52) U.S. Cl.
CPC ..... *G08G 1/0133* (2013.01); *G08G 1/0112* (2013.01)
USPC ..... 701/118; 701/117

(58) Field of Classification Search
None
See application file for complete search history.

(56) References Cited

U.S. PATENT DOCUMENTS

2009/0271084 A1* 10/2009 Taguchi ..... 701/96

FOREIGN PATENT DOCUMENTS

| | | | |
|---|---|---|---|
| JP | 2002-190090 | A | 7/2002 |
| JP | 2002-342872 | A | 11/2002 |
| JP | 2009-262862 | A | 11/2009 |
| JP | 2009-286274 | A | 12/2009 |

OTHER PUBLICATIONS

"Analysis and Prediction of Individual Vehicle Activity for Microscopic Traffic Modeling", Shauna L. Hallmark, Georgia Institute of Technology, Dec. 1999.*
International Search Report issued in PCT/JP2011/006880, mailed Jan. 17, 2012, 2 pages.

* cited by examiner

*Primary Examiner* — John R Olszewski
*Assistant Examiner* — David Merlino
(74) *Attorney, Agent, or Firm* — Arent Fox LLP

(57) ABSTRACT

A traffic congestion prediction method including the steps of: detecting an acceleration of a vehicle; calculating a power spectrum corresponding to a frequency from a frequency analysis of the detected acceleration; calculating a simple linear regression line of the power spectrum and calculating a maximum value of an amount of change in a gradient of the simple linear regression line in a predetermined frequency range as a maximum gradient value; detecting an inter-vehicle distance between the vehicle and a vehicle ahead; estimating an inter-vehicle distance distribution from the detected inter-vehicle distance by using a distribution estimation method; calculating a minimum value of covariance value from the estimated inter-vehicle distance distribution; estimating a distribution of a group of vehicles ahead from a correlation between the minimum value of covariance value and the maximum gradient value; and performing a real-time traffic congestion prediction based on the distribution of the group of vehicles.

12 Claims, 7 Drawing Sheets

(a)

(b)

TRAFFIC CONGESTION PREDICTION METHOD

CROSS-REFERENCED TO RELATED APPLICATIONS

This application is a National Stage entry of International Application No. PCT/JP2011/006880, filed Dec. 9, 2011, which claims priority to Japanese Application No. 2010-278754, filed Dec. 15, 2010, the disclosure of which is hereby incorporated in its entirety by reference.

TECHNICAL FIELD

The present invention relates to a traffic congestion prediction method, more specifically, to a method for predicting traffic congestion from an acceleration of a vehicle and an inter-vehicle distance between the vehicle and another vehicle.

BACKGROUND ART

Conventionally, traffic congestion prediction methods are proposed for a vehicle driving assist device. For example, Patent Literature 1 describes that a vehicle density of vehicles located within a predetermined distance in the front and back directions of one vehicle is calculated from a detection result of a radar device and it is determined whether or not a driving state of the one vehicle may be a cause of generation of traffic congestion by using the vehicle density.

CITATION LIST

Patent Literature

Patent Literature 1: Japanese Patent Application Laid-Open No. 2009-286274

SUMMARY OF INVENTION

Technical Problem

However, in the conventional methods including Patent Literature 1, it cannot be necessarily said that the determination accuracy of the traffic congestion prediction using the vehicle density is high, so that there is further room for improvement in order to avoid or eliminate the traffic congestion.

Therefore, an object of the present invention is to provide a traffic congestion prediction method that can properly improve the prediction accuracy of the traffic congestion and can be utilized to avoid or eliminate the traffic congestion.

Solution to Problem

The present invention is a traffic congestion prediction method including the steps of: detecting an acceleration of a vehicle; calculating a power spectrum corresponding to a frequency from a frequency analysis of the detected acceleration; calculating a simple linear regression line of the calculated power spectrum and calculating a maximum value of an amount of change in a gradient of the simple linear regression line in a predetermined frequency range as a maximum gradient value; detecting an inter-vehicle distance between the vehicle and a vehicle ahead; estimating an inter-vehicle distance distribution from the detected inter-vehicle distance by using a distribution estimation method; calculating a minimum value of covariance from the estimated inter-vehicle distance distribution; estimating a distribution of a group of vehicles ahead from a correlation between the minimum value of covariance and the maximum gradient value; and performing a real-time traffic congestion prediction based on the distribution of the group of vehicles.

According to the present invention, the traffic congestion prediction is performed based on the vehicle group distribution estimated from the correlation between the maximum gradient value obtained from the acceleration spectrum of the vehicle and the minimum value of covariance obtained from the inter-vehicle distance density, so that it is possible to improve the accuracy of the traffic congestion prediction.

According to an embodiment of the present invention, the step of performing the traffic congestion prediction includes specifying a region where variation in the vehicle group is large and a region where variation in the vehicle group is small in the vehicle group distribution and determining whether or not there is a boundary region between the above two regions.

According to an embodiment of the present invention, the presence or absence of the boundary region (transition region) of the variation of the vehicle group is used as a criterion of real-time traffic congestion prediction, so that it is possible to perform timely and effective traffic congestion prediction before the traffic congestion occurs and develops.

According to an embodiment of the present invention, the boundary region corresponds to a critical region between a free-flow region where a probability that traffic congestion occurs is low and a mixed-flow region where braking and acceleration of a vehicle are mixed.

According to an embodiment of the present invention, the critical region is used as a criterion (boundary calculation) of the traffic congestion prediction, so that it is possible to perform real-time traffic congestion prediction utilized not only to avoid traffic congestion, but also to eliminate traffic congestion. FIG. 7(*b*) shows the boundary calculation to form a pattern of the critical region.

According to an embodiment of the present invention, the step of estimating the distribution of the group of vehicles includes creating a correlation map between a logarithm of the minimum value of covariance and a logarithm of the maximum gradient value.

According to an embodiment of the present invention, the correlation map between the logarithm of the minimum value of covariance of the inter-vehicle distance and the logarithm of the maximum gradient value of the acceleration spectrum can be obtained in real time, so that it is possible to minimize a time delay occurring near the critical region in an off-line (statistical) prediction. Thus, the prediction accuracy can be improved. In other words, according to an embodiment of the present invention, the phase transition property of the traffic flow is taken into account, so that the process can be performed in real time and the prediction accuracy is higher than that of the off-line prediction.

DESCRIPTION OF EMBODIMENT

Figure 1:
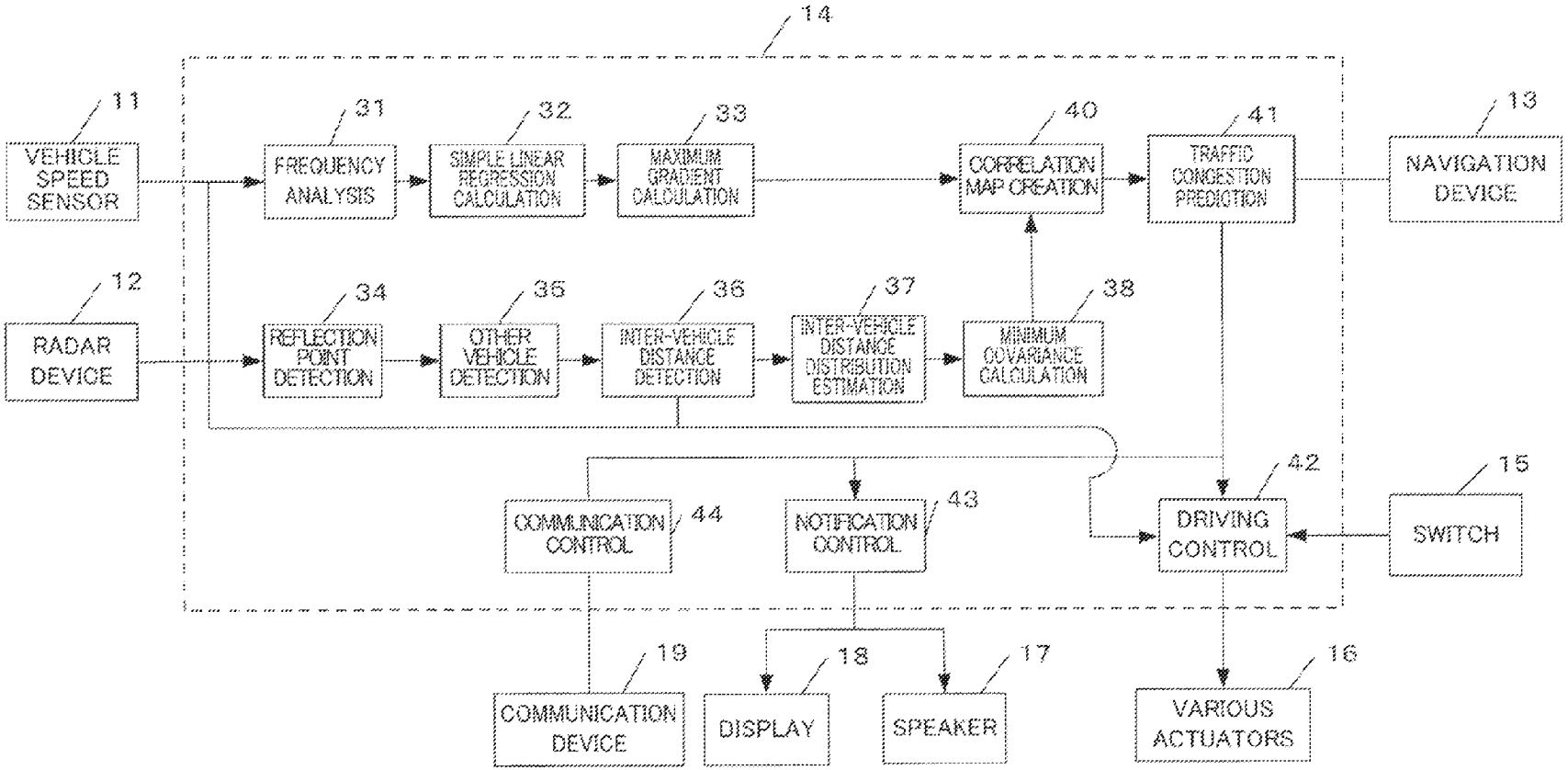
FIG. 1 is a diagram showing a configuration of a traffic congestion prediction device according to an embodiment of the present invention.

An embodiment of the present invention will be described with reference to the drawings. FIG. 1 is a block diagram showing a configuration of a traffic congestion prediction device 10 for implementing a traffic congestion prediction method according to the embodiment of the present invention. The traffic congestion prediction device 10 is mounted on a vehicle. The traffic congestion prediction device 10 can be mounted on a vehicle as one device or a part of another device.

The traffic congestion prediction device 10 includes a vehicle speed sensor 11, a radar device 12, a navigation device 13, a processing device 14, a switch 15, various actuators 16, a speaker 17, a display 18, and a communication device 19. Note that, the processing device 14 may be included in the navigation device 13. In addition, the speaker 17 and the display 18 may be realized by using the corresponding functions included in the navigation device 13.

The vehicle speed sensor 11 detects an acceleration of the vehicle and transmits the detected signal to the processing device 14. The radar device 12 divides a predetermined detection target region set around the vehicle into a plurality of angle regions and emits an electromagnetic wave such as an infrared laser and a millimeter wave while scanning each angle region. The radar device 12 receives a reflected signal (electromagnetic wave) from an object in the detection target region and transmits the reflected signal to the processing device 14.

The navigation device 13 receives a positioning signal such as a GPS signal and calculates the current position of the vehicle from the positioning signal. The navigation device 13 can also calculate the current position of the vehicle by using autonomous navigation from the acceleration and the yaw rate detected by the vehicle speed sensor 11 and a yaw-rate sensor (not shown). The navigation device 13 includes map data and has a function to output the current position of the vehicle, route information to a destination, and traffic congestion information on a displayed map.

The processing device 14 includes a frequency analysis unit 31, a simple linear regression calculation unit 32, a maximum gradient calculation unit 33, a reflection point detection unit 34, an other vehicle detection unit 35, an inter-vehicle distance detection unit 36, an inter-vehicle distance distribution estimation unit 37, a minimum covariance calculation unit 38, a correlation map creation unit 40, a traffic congestion prediction unit 41, a driving control unit 42, a notification control unit 43, and a communication control unit 44. The functions of each block are realized by a computer (CPU) included in the processing unit 14. The details of the functions of each block will be described later.

As a hardware configuration, the processing unit 14 includes, for example, an A/D conversion circuit that converts an input analog signal into an digital signal, a central processing unit (CPU) that performs various calculations, a RAM used by the CPU to store data when the CPU performs a calculation, a ROM that stores programs executed by the CPU and data (including tables and maps) used by the CPU, an output circuit that outputs a drive signal to the speaker 17 and a display signal to the display 18, and the like.

The switch 15 outputs various signals related to driving control of the vehicle to the processing device 14. The various signals include, for example, operation (position) signals of an accelerator pedal and a brake pedal and various signals related to automatic cruise control (ACC) (start control, stop control, target vehicle speed, inter-vehicle distance, and the like).

The various actuators 16 are used as a generic name of a plurality of actuators and include, for example, a throttle actuator, a brake actuator, a steering actuator, and the like.

The display 18 includes a display such as an LCD and may be a display with a touch panel function. The display 18 may include a voice output unit and a voice input unit. The display 18 notifies a driver of an alarm by displaying predetermined alarm information or lighting/blinking a predetermined alarm lamp according to a control signal from the notification control unit 43. The speaker 17 notifies a driver of an alarm by outputting a predetermined alarm sound or voice according to a control signal from the notification control unit 43.

The communication device 19 communicates with another vehicle, a server device (not shown), or a relay station (not shown) by wireless communication under control of the communication control unit 44, associates a traffic congestion prediction result and position information, which are outputted from the traffic congestion prediction unit 41, with each other and transmits them, and receives correspondence information between a traffic congestion prediction result and position information from another vehicle or the like. The acquired information is transmitted to the notification control unit 43 or the driving control unit 42 through the communication control unit 44.

Figure 2:
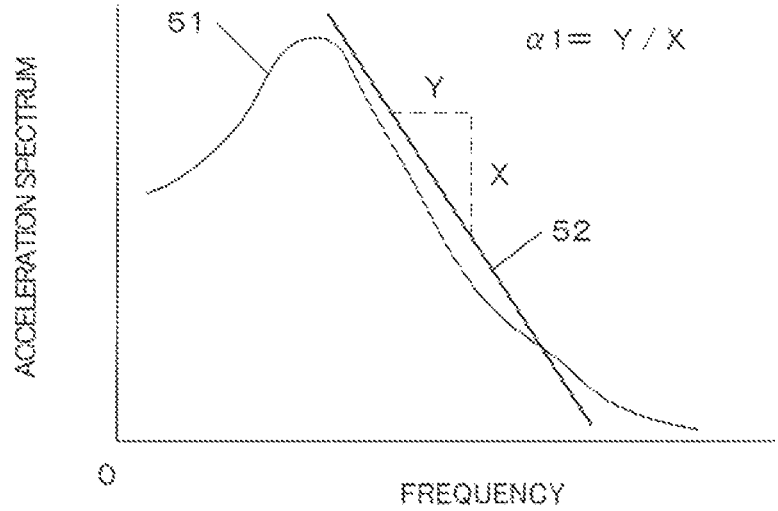
FIG. 2 is a diagram showing an acceleration spectrum according to an embodiment of the present invention.
Figure 2:
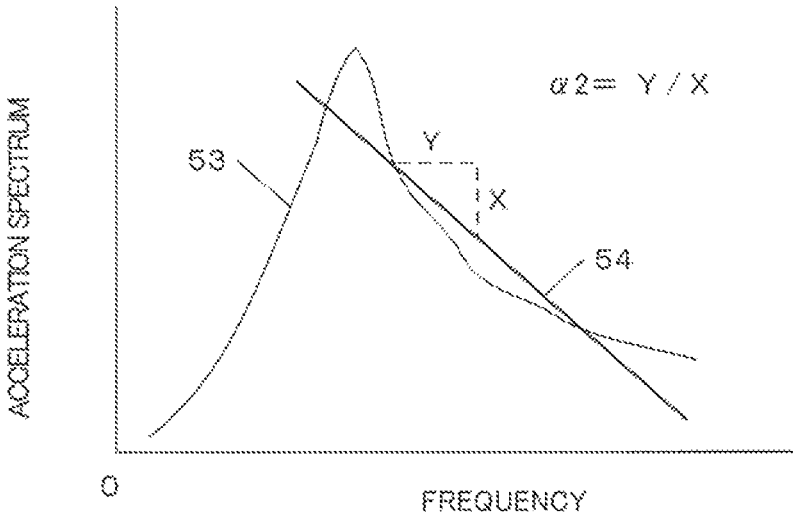

Next, the functions of each block in the processing unit 14 will be described. The frequency analysis unit 31 performs frequency analysis on the acceleration of the vehicle detected by the vehicle speed sensor 11 and calculates a power spectrum. FIG. 2 shows examples of the power spectrum in two different driving states (a) and (b). In FIG. 2, as power spectrums, acceleration spectrums 51 and 53 corresponding to frequencies are illustrated.

The simple linear regression calculation unit 32 performs a simple linear regression analysis on an obtained power spectrum and calculates a simple linear regression line. In the examples of FIG. 2, straight lines denoted by reference numerals 52 and 54 are simple linear regression lines obtained corresponding to the acceleration spectrums 51 and 53 respectively.

The maximum gradient calculation unit 33 calculates a maximum gradient value from the obtained simple linear regression line. In the examples of FIG. 2, first, the maximum gradient calculation unit 33 calculates the gradients of the simple linear regression lines 52 and 54. Specifically, in FIG. 2, the maximum gradient calculation unit 33 calculates $\alpha$ (=Y/X) based on a change X of the spectrum value in a predetermined frequency range Y (for example, a frequency range of 0 to 0.5 Hz which corresponds to a time range from several seconds to several minutes). In FIG. 2, $\alpha$1 and $\alpha$2 which are gradients in (a) and (b) are obtained.

Next, a difference between the obtained gradients $\alpha$, that is, a difference $\Delta\alpha$ ($=\alpha_k-\alpha_{k-1}$) between the gradients $\alpha_k$ and $\alpha_{k-1}$ at a predetermined time interval, is calculated. A maximum value of temporal change of the obtained difference $\Delta\alpha$ or temporal change of a parameter obtained from the difference $\Delta\alpha$ (for example, a square value $(\Delta\alpha)^2$ or an absolute value $|\Delta\alpha|$) is obtained. The obtained maximum value is stored in a memory (RAM or the like) in the processing device 14 as a maximum value.

The reflection point detection unit 34 detects a position of a reflection point (object) from the reflected signal detected by the radar device 12. The other vehicle detection unit 35 detects at least one other vehicle or more located around the vehicle from a distance between reflection points adjacent to each other, a distribution state of the reflection points, and the like based on position information of the reflection points outputted from the reflection point detection unit 34. The inter-vehicle distance detection unit 36 detects inter-vehicle distances between the vehicle and other vehicles from other vehicle information detected by the reflection point detection unit 34 and outputs the detection result along with the number of the detected other vehicles.

Figure 3:
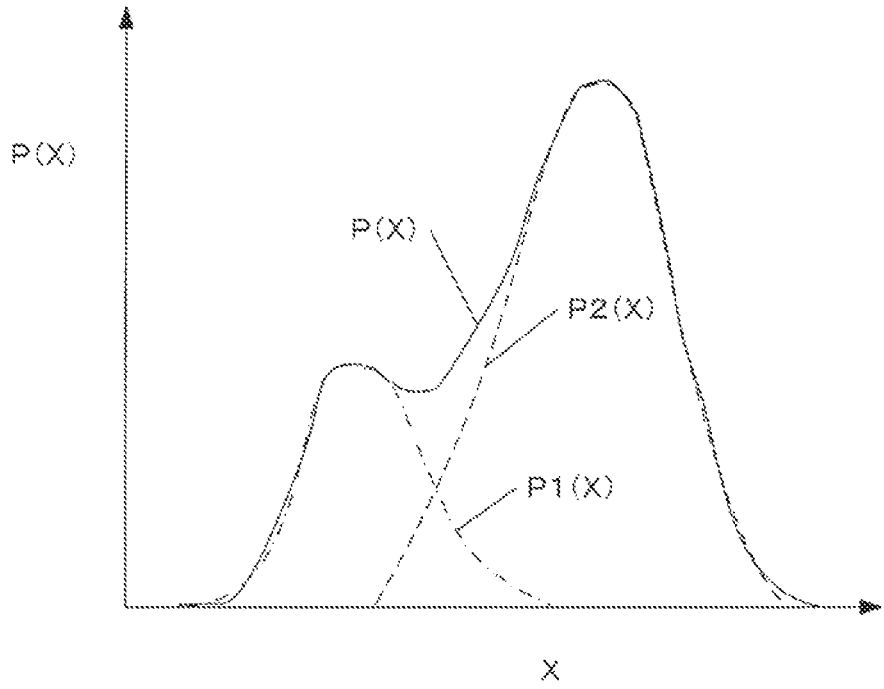
FIG. 3 is a diagram showing a probability density distribution according to an embodiment of the present invention.

The inter-vehicle distance distribution estimation unit 37 estimates an inter-vehicle distance distribution from information of the inter-vehicle distances and the number of vehicles outputted from the inter-vehicle distance detection unit 36. The inter-vehicle distance distribution estimation will be described with reference to FIG. 3. FIG. 3 is a diagram showing a probability density distribution.

When a group of vehicles ahead, that is, an aggregation of vehicles in which inter-vehicle distances are relatively short, can be observed from the information of the inter-vehicle distances and the number of vehicles, Gaussian distribution (probability density distribution) is applied to each vehicle group by using a distribution estimation method such as variational Bayes. For example, if there are two vehicle groups, it is possible to treat the vehicle groups as a distribution in which two Gaussian distributions are linearly-combined. Specifically, as shown in FIG. 3, a probability function P(X) that represents the entire distribution can be obtained as a sum (superposition) of probability functions P1(X) and P2(X) that represent the two Gaussian distributions.

When the Gaussian distribution (probability function) is represented by $N(X|\mu, \Sigma)$, the superposition of a plurality of Gaussian distributions as illustrated in FIG. 3 can be obtained by the following formula:

$$p(x) = \sum_{k=1}^{K} \pi_k N(x \mid \mu_k, \Sigma_k) \quad \text{[Formula 1]}$$

Here, $\mu_k$ is an expected value (average value) and represents a position at which the density is the highest. $\Sigma_k$ is a covariance value (matrix) and represents a distortion of the distribution, that is, how the density decreases as going away from the expected value in what direction. $\pi_k$ is a mixing coefficient (mixing ratio) and represents a ratio ($0 \leq \pi_k \leq 1$) indicating how much each Gaussian distribution contributes. The mixing coefficient $\pi_k$ can be treated as a probability.

The minimum covariance calculation unit 38 performs calculation by using the variational Bayes or the like in order to obtain a parameter (covariance) at which a likelihood function obtained from the P(X) described above is the maximum. When the Gaussian distribution P(X) is obtained as a superposition of a plurality of Gaussian distributions as illustrated in FIG. 3, the covariance value $\Sigma_k$ is calculated for each Gaussian distribution.

Figure 4:
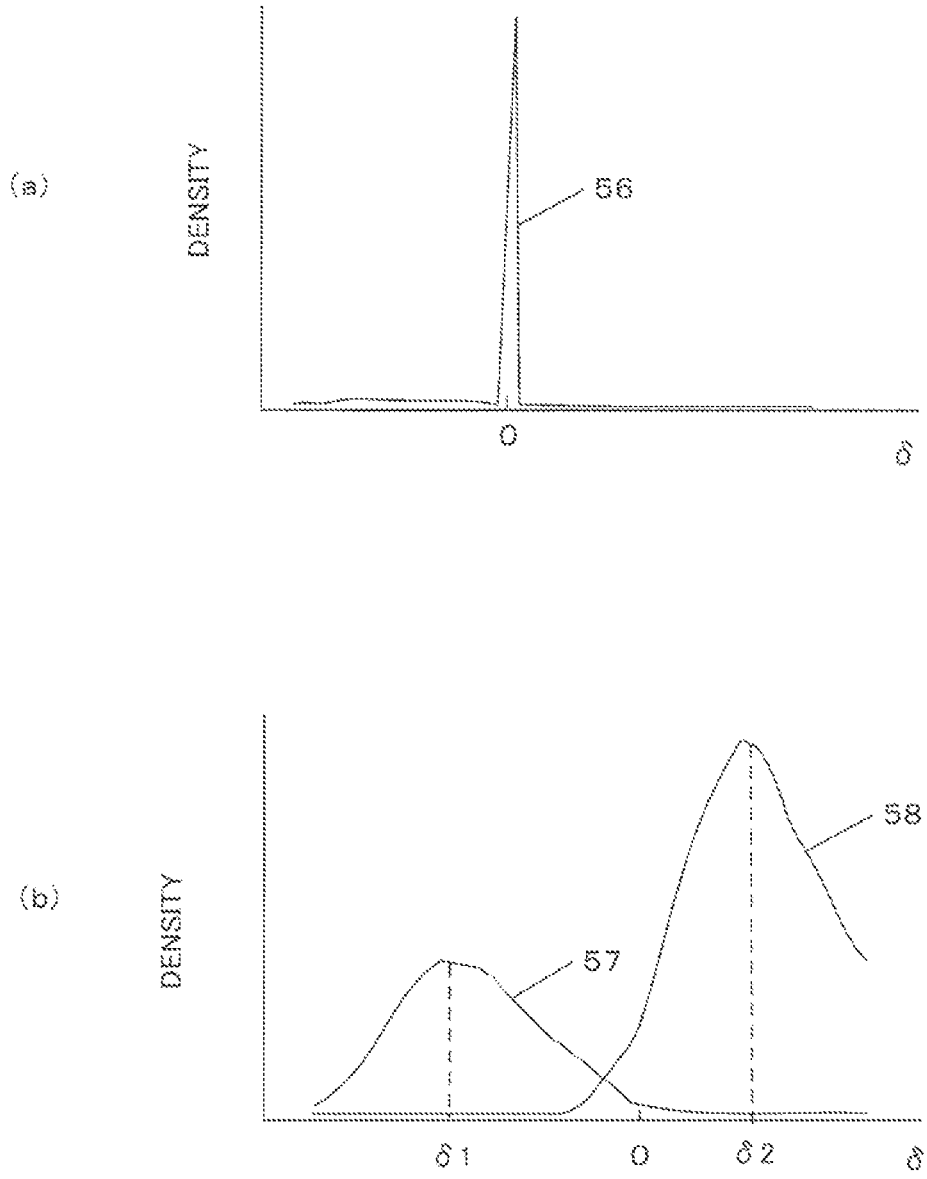
FIG. 4 is a diagram schematically showing a covariance value $\Sigma_k$ according to an embodiment of the present invention.

Next, the minimum covariance calculation unit 38 calculates a minimum value of a plurality of covariance values $\Sigma_k$ obtained for each Gaussian distribution P(X). FIG. 4 is a diagram schematically showing the covariance value $\Sigma_k$. In FIG. 4(*a*), a graph 56 showing the covariance value $\Sigma_k$ has a sharp shape at delta (δ) 0, which indicates that there is no variation in the vehicle group, that is, the vehicles are in a driving state in which the inter-vehicle distances are substantially constant. On the other hand, in FIG. 4(*b*), two graphs are obtained which are a graph 57 having a peak at δ1 in a region where the delta (δ) is negative and a graph 58 having a peak at δ2 in a region where the delta (δ) is positive. Both the graphs 57 and 58 have a predetermined fluctuation range (δ), which indicates that there is a variation in the vehicle group, that is, there are a plurality of aggregations of vehicles whose inter-vehicle distances are different. In FIG. 4, the minimum value of the covariance value $\Sigma_k$ is substantially zero in FIG. 4(*a*) and δ1 which is the smaller one of δ1 and δ2 in FIG. 4(*b*).

Figure 5:
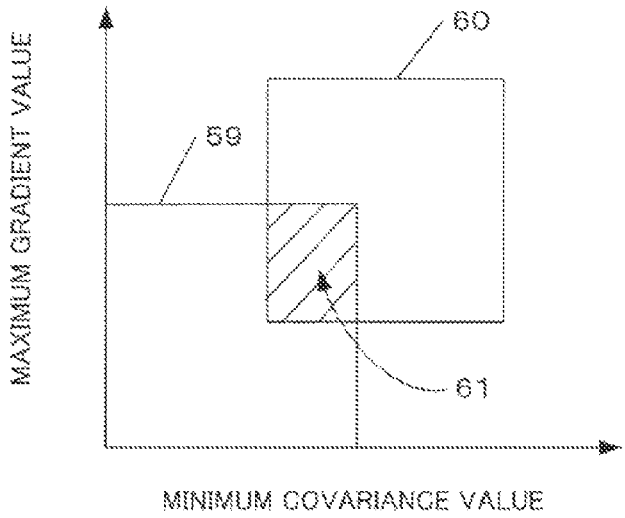
FIG. 5 is an image (conceptual) diagram of a correlation map between a maximum gradient value and a minimum covariance value according to an embodiment of the present invention.

The correlation map creation unit 40 in FIG. 1 creates a correlation map between the maximum gradient value calculated by the maximum gradient calculation unit 33 and the minimum covariance value calculated by the minimum covariance calculation unit 38. FIG. 5 is an image diagram (conceptual) diagram of the correlation map between the maximum gradient value and the minimum covariance value. In FIG. 5, the horizontal (X) axis represents the minimum covariance value X, the vertical (Y) axis represents the maximum gradient value Y, and the correlation between the variables (X, Y) is mapped. Two regions denoted by reference numerals 59 and 60 are shown and there is a boundary region 61 where the two regions overlap each other. In the region 59, the minimum covariance value is relatively small, which corresponds to a state in which the variation in the vehicle group is small, that is, a state in which the inter-vehicle distances are relatively constant. On the other hand, in the region 60, the minimum covariance value is relatively large, which corresponds to a state in which the variation in the vehicle group is large, that is, a state in which there are a plurality of aggregations of vehicles whose inter-vehicle distances are different. The boundary region 61 is a region in which the state in which the variation in the vehicle group is small transits to a state in which the variation in the vehicle group is large. The present invention is characterized in that the traffic congestion prediction is performed by quantitatively detecting the state of the vehicle group corresponding to the boundary region 61.

Figure 6:
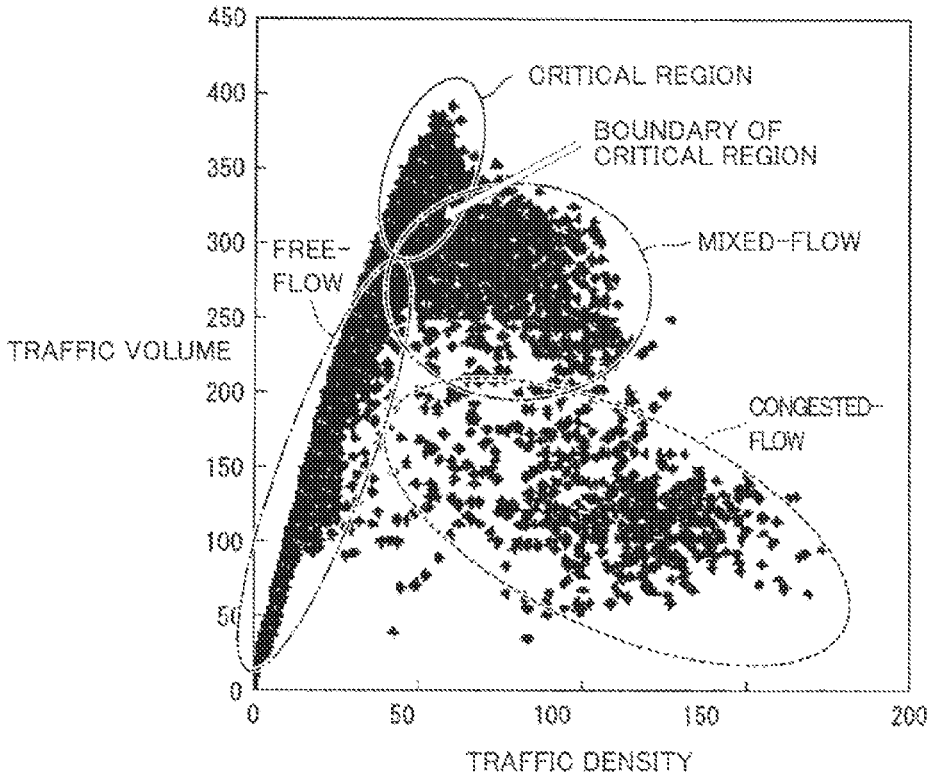
FIG. 6 is a diagram showing a relationship between a traffic density and a traffic volume.

Here, each region illustrated in FIG. 5 will be further described with reference to FIG. 6. FIG. 6 is a diagram showing a relationship between a traffic density and a traffic volume. The horizontal (X) axis in the graph represents the traffic density that indicates the number of vehicles located within a predetermined distance from the vehicle. The reciprocal number of the traffic density corresponds to the inter-vehicle distance. The vertical (Y) axis represents the traffic volume that indicates the number of vehicles passing through a predetermined position. It is possible to perceive that FIG. 6 shows a traffic flow that indicates a flow of vehicles.

The traffic flow illustrated in FIG. 6 can be roughly divided into four states (regions). The first one is a free-flow state where there is a low possibility of traffic congestion. In this state, it is possible to ensure an acceleration of the vehicle and an inter-vehicle distance that are more than a certain level. The second one is a mixed-flow state where a vehicular braking state and an acceleration state are mixed. The mixed-flow state is a state before transiting to a congested-flow and is a state in which the degree of freedom of a driver decreases and there is a high probability that the state transits to the congested-flow by a decrease of the traffic flow and an increase of the traffic density (decrease of inter-vehicle distance). The third one is a congested-flow state that indicates traffic congestion. The fourth one is a critical region which is a transition state present on a transition path from the free-flow state to the mixed-flow state. This region is a state in which the traffic volume and the traffic density are higher than those in the free-flow and is a state which transits to the mixed-flow by a decrease of the traffic volume and an increase of the traffic density (decrease of inter-vehicle distance). The critical region may be referred to as a quasi-stable flow or a metastable flow.

From the relationship between FIG. 5 and FIG. 6, the region 59 in FIG. 5 includes the free-flow and the critical region in FIG. 6, and the region 60 in FIG. 5 includes the mixed-flow state and the congested-flow state in FIG. 6. Therefore, the boundary region in FIG. 5 is a boundary state including both of the critical region and the mixed-flow state in FIG. 6, so that the boundary region in FIG. 5 is referred to as a boundary of the critical region as shown in FIG. 6. An aim of the present invention is to quantitatively detect the critical region including the boundary of the critical region, control the transition to the mixed-flow state, and prevent the traffic congestion from occurring.

Figure 7:
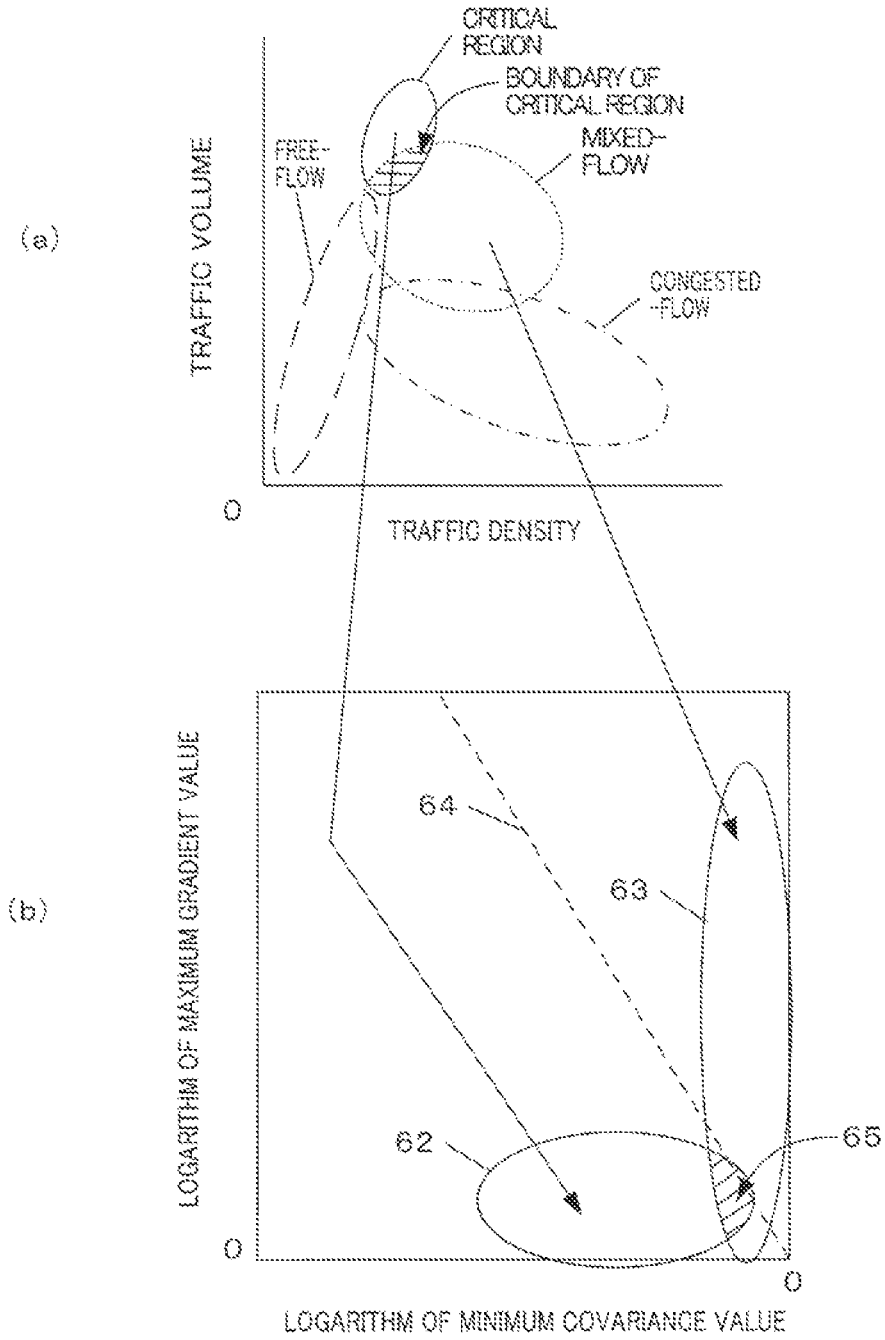
FIG. 7 is a correlation map between the logarithm of the minimum covariance value of an inter-vehicle distance distribution and the logarithm of the maximum gradient value of the acceleration spectrum according to an embodiment of the present invention.

The quantification of the critical region will be described with reference to FIG. 7. FIG. 7 is a diagram showing a correlation map between the logarithm of the minimum covariance value of the inter-vehicle distance distribution and the logarithm of the maximum gradient value of the acceleration spectrum. FIG. 7(*a*) is a diagram schematically depicting the traffic flow map in FIG. 6 and FIG. 7(*b*) shows a correlation map between the logarithm of the minimum covariance value and the logarithm of the maximum gradient value. The logarithm of the minimum covariance value and the logarithm of the maximum gradient value in FIG. 7(*b*) are calculated as a logarithmic value of the maximum gradient value calculated by the maximum gradient calculation unit 33 and the minimum covariance value calculated by the minimum covariance calculation unit 38. FIG. 7(*b*) is a diagram depicting parameterization of a phase transition state in the critical region by a single vehicle.

In FIG. 7(*b*), a region denoted by reference numeral 62 includes the critical region in FIG. 7(*a*) and a region denoted by reference numeral 63 includes the mixed-flow state in FIG. 7*a*). A line denoted by reference numeral 64 is a critical line, which means a critical point of a high probability that the state reaches the traffic congestion if the state transits to the mixed-flow state over the critical line. The boundary region 65 between the regions 62 and 63 corresponds to a boundary of the critical region immediately before the critical line 64. The correlation map illustrated in FIG. 7(*b*) is stored in a memory (RAM or the like) in the processing device 14.

The traffic congestion prediction unit 41 in FIG. 1 determines whether or not the boundary state of the critical region is present in the correlation map created by the correlation map creation unit 40 and, if the boundary state is present, the traffic congestion prediction unit 41 transmits a control signal including the traffic congestion prediction result to the driving control unit 42, the notification control unit 43, and the communication control unit 44 in order to prevent the transition to the traffic congestion. Thereby, it is possible to perform various controls described below and prevent the transition to the mixed-flow illustrated in FIG. 7 from occurring. As a result, the traffic congestion prediction which is helpful in not only traffic congestion avoidance, but also eliminating traffic congestion can be possible.

The traffic congestion prediction unit 41 outputs the traffic congestion prediction result to the navigation device 13. The navigation device 13 can perform route search and route guidance of the vehicle in order to avoid traffic congestion based on the traffic congestion prediction result received from the traffic congestion prediction unit 41 and a traffic congestion prediction result predicted by another vehicle and outputted from the communication control unit 44.

The driving control unit 42 controls the driving of the vehicle by controlling various actuators based on the traffic congestion prediction result outputted from the traffic congestion prediction unit 41, the traffic congestion prediction result predicted by another vehicle and outputted from the communication control unit 44, various signals outputted from the switch 15, the detection result of acceleration of the vehicle outputted from the vehicle speed sensor 11, and the detection result of the inter-vehicle distance outputted from the inter-vehicle distance detection unit 36. Specifically, for example, the driving control unit 42 starts or stops execution of the automatic cruise control (ACC) and sets or changes the target vehicle speed and the target inter-vehicle distance of the ACC according to the signals outputted from the switch 15.

The notification control unit 43 performs notification control using the display 18 and the speaker 17 based on the traffic congestion prediction result outputted from the traffic congestion prediction unit 41 and the traffic congestion prediction result predicted by another vehicle and outputted from the communication control unit 44. For example, the notification control unit 43 transmits a control signal to display a message "slow down and increase the inter-vehicle distance" on the display 18 or output the message by voice from the speaker 17.

Figure 8:
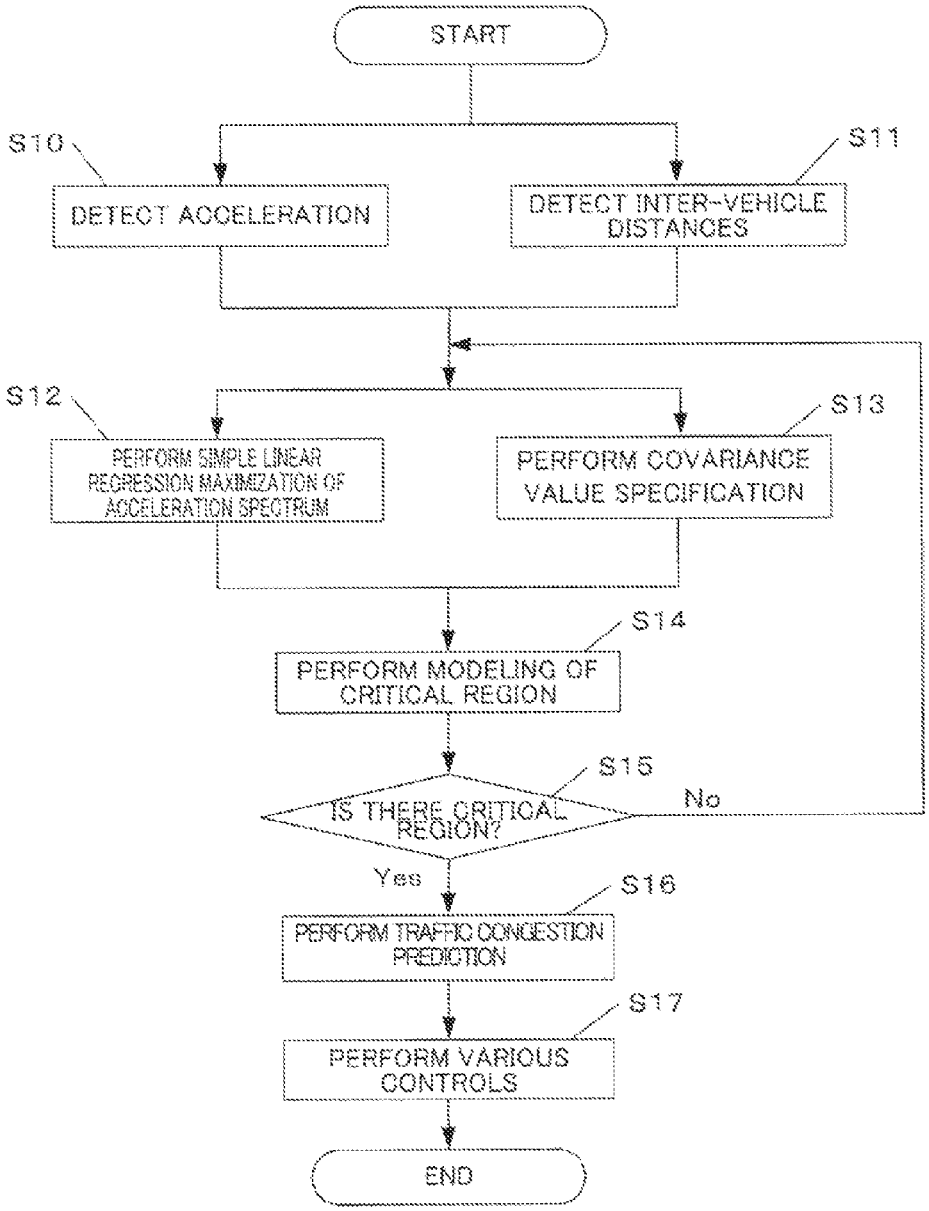
FIG. 8 is a flowchart of the traffic congestion prediction according to an embodiment of the present invention.

FIG. 8 is a flowchart of the traffic congestion prediction according to the embodiment of the present invention. Note that, the details of each step are as described above. In step S10, the acceleration of the vehicle is detected by the vehicle speed sensor 11. In parallel with the above, in step S11, the inter-vehicle distances between the vehicle and vehicles around the vehicle are detected based on the output signal from the radar device 12 (blocks 34 to 36 in FIG. 1). In step S12, simple linear regression maximization of the acceleration spectrum is performed. Specifically, the maximum gradient value described above is calculated (blocks 31 to 33 in FIG. 1). In parallel with the above, in step S13, covariance value specification is performed. Specifically, the minimum covariance value described above is calculated (blocks 37 and 38 in FIG. 1).

In step S14, modeling of the critical region is performed. Specifically, a correlation map as illustrated in FIG. 7(*b*) described above is created (block 40 in FIG. 1). In step S15, whether or not a critical region (and the boundary thereof) is present is determined. The critical region is the critical region illustrated in FIGS. 6 and 7(*a*) described above. If the determination is "No", the process returns to steps S12 and S13 and repeats the following flow. If the determination is "Yes", in the next step S16, the traffic congestion prediction is performed (block 41 in FIG. 1). In step S17, various controls are performed according to a result of the traffic congestion prediction (blocks 42 to 44 in FIG. 1).

Although the embodiment of the present invention has been described, the present invention is not limited to the embodiment, but may be modified and used without departing from the scope of the present invention.

| Reference Signs List | |
|---|---|
| 10 | Traffic congestion prediction device |
| 14 | Processing device |
| 51, 53 | Acceleration (power) spectrum |
| 52, 54 | Simple linear regression line |
| 56, 57, 58 | Covariance |

The invention claimed is:

1. A traffic congestion prediction method comprising the steps of:

detecting an acceleration of a vehicle;

calculating a power spectrum corresponding to a frequency from a frequency analysis of the acceleration;

calculating a simple linear regression line of the power spectrum and calculating a maximum value of an amount of change in a gradient of the simple linear regression line in a predetermined frequency range as a maximum gradient value;

detecting an inter-vehicle distance between the vehicle and a vehicle ahead;

estimating an inter-vehicle distance distribution from the inter-vehicle distance by using a distribution estimation method;

calculating a minimum value of covariance from the inter-vehicle distance distribution;

estimating a distribution of a group of vehicles ahead from a correlation between the minimum value of covariance and the maximum gradient value; and performing a traffic congestion prediction based on the distribution of the group of vehicles.

2. The traffic congestion prediction method according to claim 1, wherein the step of performing the traffic congestion prediction includes specifying a region where variation in the vehicle group is large and a region where variation in the vehicle group is small in the vehicle group distribution and determining whether or not there is a boundary region between the two regions.

3. The traffic congestion prediction method according to claim 2, wherein the boundary region corresponds to a critical region between a free-flow region where a probability that traffic congestion occurs is low and a mixed-flow region where braking and acceleration of a vehicle are mixed.

4. The traffic congestion prediction method according to claim 1, wherein the step of estimating the distribution of the group of vehicles includes creating a correlation map between a logarithm of the minimum value of the covariance and a logarithm of the maximum gradient value.

5. A traffic congestion prediction device comprising:

a vehicle speed sensor configured to detect an acceleration of a vehicle; and a processing unit configured to calculate a power spectrum corresponding to a frequency from a frequency analysis of the acceleration;

calculate a simple linear regression line of the power spectrum and calculating a maximum value of an amount of change in a gradient of the simple linear regression line in a predetermined frequency range as a maximum gradient value;

detect an inter-vehicle distance between the vehicle and a vehicle ahead;

estimate an inter-vehicle distance distribution from the inter-vehicle distance by using a distribution estimation method;

calculate a minimum value of covariance from the inter-vehicle distance distribution;

estimate a distribution of a group of vehicles ahead from a correlation between the minimum value of covariance and the maximum gradient value; and perform a traffic congestion prediction based on the distribution of the group of vehicles.

6. The traffic congestion prediction device according to claim 5, wherein the traffic congestion prediction includes specifying a region where variation in the vehicle group is large and a region where variation in the vehicle group is small in the vehicle group distribution and determining whether or not there is a boundary region between the two regions.

7. The traffic congestion prediction device according to claim 6, wherein the boundary region corresponds to a critical region between a free-flow region where a probability that traffic congestion occurs is low and a mixed-flow region where braking and acceleration of a vehicle are mixed.

8. The traffic congestion prediction device according to claim 5, wherein the processing unit is configured to estimate the distribution of the group of vehicles by creating a correlation map between a logarithm of the minimum value of the covariance and a logarithm of the maximum gradient value.

9. A traffic congestion prediction device comprising:

a vehicle speed sensor for detecting an acceleration of a vehicle; and a processing unit comprising means for calculating a power spectrum corresponding to a frequency from a frequency analysis of the acceleration, means for calculating a simple linear regression line of the power spectrum and calculating a maximum value of an amount of change in a gradient of the simple linear regression line in a predetermined frequency range as a maximum gradient value, means for detecting an inter-vehicle distance between the vehicle and a vehicle ahead, means for estimating an inter-vehicle distance distribution from the inter-vehicle distance by using a distribution estimation method, means for calculating a minimum value of covariance from the inter-vehicle distance distribution, means for estimating a distribution of a group of vehicles ahead from a correlation between the minimum value of covariance and the maximum gradient value, and means for performing a traffic congestion prediction based on the distribution of the group of vehicles.

10. The traffic congestion prediction device according to claim 9, wherein the traffic congestion prediction includes specifying a region where variation in the vehicle group is large and a region where variation in the vehicle group is small in the vehicle group distribution and determining whether or not there is a boundary region between the two regions.

11. The traffic congestion prediction device according to claim 10, wherein the boundary region corresponds to a critical region between a free-flow region where a probability that traffic congestion occurs is low and a mixed-flow region where braking and acceleration of a vehicle are mixed.

12. The traffic congestion prediction device according to claim 9, wherein the processing unit comprises means for estimating the distribution of the group of vehicles by creating a correlation map between a logarithm of the minimum value of the covariance and a logarithm of the maximum gradient value.

* * * * *